United States Patent [19]

Faulin

[11] Patent Number: 4,571,858

[45] Date of Patent: Feb. 25, 1986

[54] SKI SHOE SOLE

[76] Inventor: Antonio Faulin, Via Giovanni da Procida 4, Milano, Italy

[21] Appl. No.: 577,937

[22] Filed: Feb. 7, 1984

[30] Foreign Application Priority Data

Feb. 21, 1983 [IT] Italy ..... 19671 A/83

[51] Int. Cl.[4] ..... A43B 5/04

[52] U.S. Cl. ..... 36/117

[58] Field of Search ..... 36/117

[56] References Cited

U.S. PATENT DOCUMENTS

| | | | |
|---|---|---|---|
| 3,925,911 | 12/1975 | Erlebach | 36/117 |
| 4,060,256 | 11/1977 | Colombin et al. | 36/117 X |
| 4,102,063 | 7/1978 | Ihlen | 36/117 |

FOREIGN PATENT DOCUMENTS

| | | | |
|---|---|---|---|
| 3113941 | 10/1982 | Fed. Rep. of Germany | 36/117 |
| 584015 | 12/1977 | Switzerland | 36/117 |

*Primary Examiner*—Louis K. Rimrodt

*Attorney, Agent, or Firm*—Guido Modiano; Albert Josif

[57] ABSTRACT

A ski shoe sole of a type provided with a rear recess and a peg in the sole bottom toe portion for removable engagement with ski bindings has on its inside a reinforcing element extending longitudinally and centrally over approximately the full length of the sole. The reinforcing element is enlarged and flattened at the front, and has progressively increasing thickness and width dimensions toward the rear. The reinforcing element is formed from a plastic material and the sole remainder is cured, heat formed, or injected all around it. The recess is formed rearwards of the reinforcing element, and the front peg is secured to a metal plate accommodated in the reinforcing element parallel to the sole main plane. The sole is substantially rigid as far as ski binding-induced stresses are concerned, but is adequately flexible at the toe region to facilitate normal walking.

7 Claims, 11 Drawing Figures

8
4
4
1
7
3
3
6
9
8
5
5
20
20
8b
8
8b
9
8a
1
20
20
12
11
20
16
20
1a
8b
4
8
3
1
8a
11
9
6
20
8a
5

SKI SHOE SOLE

BACKGROUND OF THE INVENTION

This invention relates to a ski shoe sole.

More specifically, the invention is concerned with a ski shoe sole of a type which can be associated with ski bindings, comprising a rear automatic release assembly having a pusher element adapted for releasably engaging with a recess in the rear portion of the shoe heel and acting in the longitudinal direction of the shoe, and a front automatic release assembly having an engagement element detachably cooperating with a peg or nail located under the toe portion of the shoe sole. Ski bindings of the kind referred to above also comprise, as disclosed in the U.S. Pat. No. 4,353,574 by this same Applicant a substantially rigid rod-like element which is connected pivotally to the rear release assembly and partially encircles the skier's leg for transferring side thrust forces from the skier's leg to the ski.

A shoe for a ski binding of this type behaves substantially as a soft shoe because it has no longer to serve as a rigid element for transmitting forces from the skier's leg to the ski.

Accordingly, the shoe may be used, not only for skiing but also for walking. The sole of such a shoe should, however, possess adequate strength on account of its being stressed in the longitudinal direction by a compressive force which is applied substantially in the sole main plane and due to the rear pusher element biasing the sole toward the front release assembly. Inadequate strength would result in the sole being flexed under compression and the shoe being released from its binding, or at least in preventing proper engagement of the shoe with the binding in normal skiing conditions.

On the other hand, too stiff a sole would defeat a comfortable deambulation and the advantages of using a soft shoe afforded by the binding.

An attempt has been made to strengthen the shoe at the foot hollow region by disposing a substantially plate-like reinforcing element between the shoe upper and top of the sole. That approach has proved substantially successful in meeting such conflicting requirements, but poses practical construction problems which make implementation of the shoe as a whole more expensive and complicated.

Another problem encountered with the shoes in question is that of firmly anchoring the peg in the sole, which again involves a sufficiently rigid sole construction, while posing some significant practical manufacturing problems.

SUMMARY OF THE INVENTION

It is an object of this invention to provide a ski shoe as indicated in the preamble, which additionally to being adequately rigid for ski practice, is also sufficiently soft and pliable to permit deambulation, and this while involving a relatively economical manufacturing procedure.

A further object of the invention is to provide a sole for a ski shoe as indicated, which can afford an easy and firm anchoring of the peg in the sole, and differentiated flexibility lengthwise.

It is another object of this invention to provide a sole which has improved characteristics over the prior art soles of the cited Patent, both as regards safety and proper performance in releasing the shoe from the ski binding.

These and other objects, such as will become apparent hereinafter, are achieved by a sole of a ski shoe of a type provided with a rear recess for releasable engagement with a pusher element of a rear automatic release assembly of a ski binding, and an engaging element of substantially peg-like configuration or in releasable cooperation with a peg of a front automatic release assembly of the ski binding under the sole toe portion, said sole being characterized in that said recess and said engaging element are provided on a reinforcing element extending lengthwise in the sole inside and being embedded therein.

Advantageously, in a sole so constructed, the reinforcing element, which only occupies the longitudinal center region of the sole, i.e. the very region where the binding compression and bending stresses act, achieves the required degree of stiffness to prevent undesired flexing of the sole while skiing, whereas the remaining portion of the sole, unaffected by the reinforcing element, may be made comparatively soft, thereby the sole can be imparted with a desired pliability without jeopardizing its required stiffness. The sole manufacturing is also particularly advantageous, because the reinforcing element may be formed from a plastic material and the rubber sole be thermoformed or injected around it. The reinforcing element configuration may be dimensioned as required to impart the sole with differentiated flexibility at various areas thereof, or the reinforcing element may be itself reinforced at some areas, such as by means of metal inserts. More specifically, the front peg or nail may be upset onto a substantially rigid metal plate either embedded or otherwise accommodated within the reinforcing element and then fully embedded in the sole itself. Thus, a strong engagement of the peg with the sole is achieved.

BRIEF DESCRIPTION OF THE DRAWINGS

Further features and advantages of the invention will be more readily understood from the following detailed description of two preferred embodiments thereof, given herein by way of example only with reference to the accompanying illustrative drawings, where.

DESCRIPTION OF THE PREFERRED EMBODIMENT

Figures 1, 2, 3:
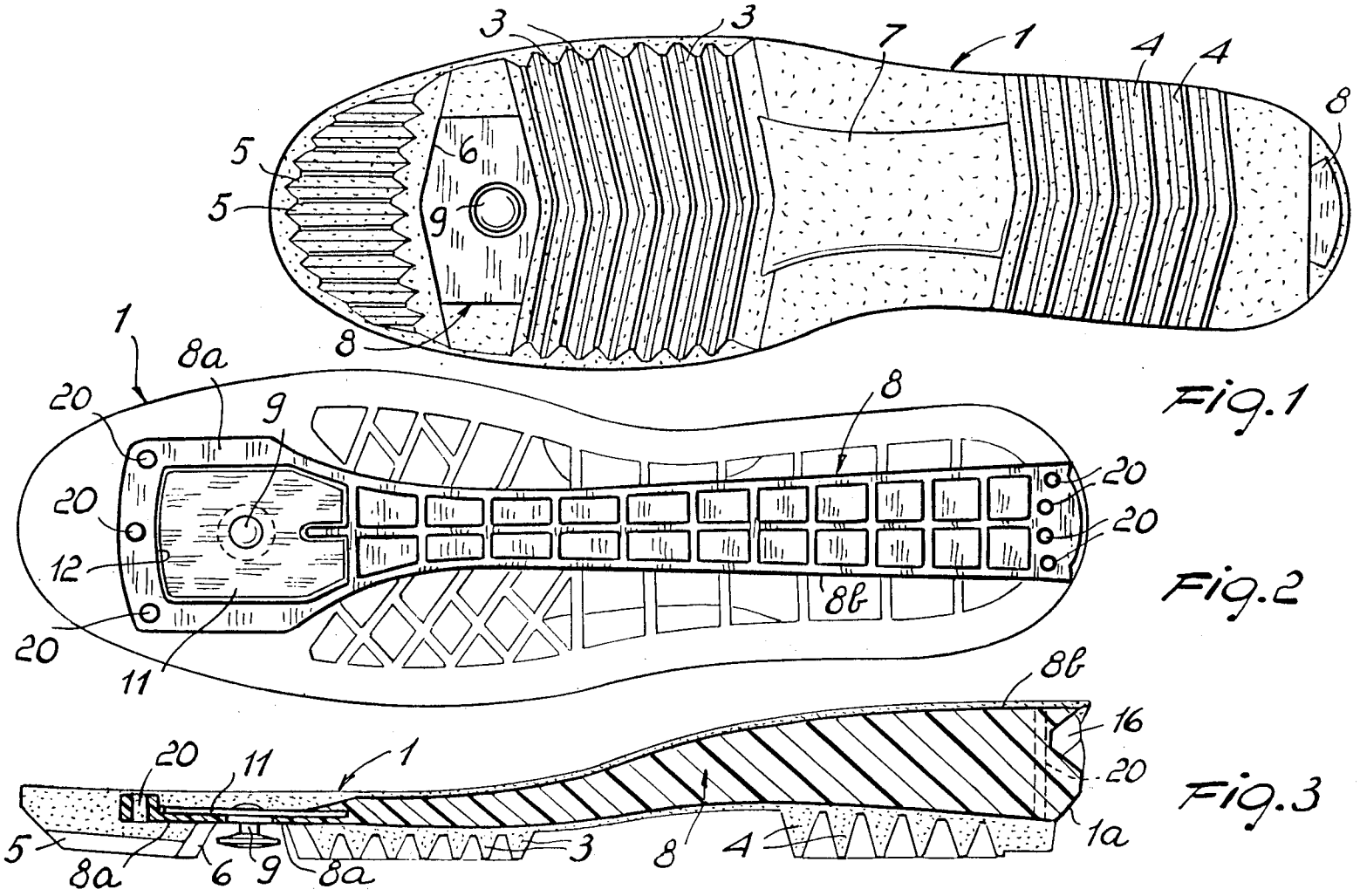
FIG. 1 is a bottom view of a sole according to the invention.
FIG. 2 shows the opposite side of the sole.
FIG. 3 is a longitudinal section view taken through the sole of the preceding figures along a centerplane perpendicular to the sole main plane.

Making reference to the drawing views, a sole 1 for a ski shoe 2, according to the invention, is provided on its bottom surface with a plurality of ridges or ribs 3,4 separated by grooves or depressions and extending across the sole, optionally in a chevron configuration. Additional ridges or ribs 5 may be provided at the bottom toe portion of the sole 1, and this in order to achieve a good grip on the ground when the shoe 2 is used for normal walking activities, as well as to break loose any snow or ice formations between the sole and ski when the shoe 2 is used for skiing activities.

Between the ridge sets 3 and 5, the sole 1 has a crosswise cutout 6 for accommodating a front release assembly of a ski binding, as explained hereinafter, and between the ridge sets 3 and 4 there is formed a longitudinal bridge 7. The sole 1 is preferably made of rubber.

Embedded within the sole 1 is a reinforcing element 8 of a substantially rigid material, such as a plastic material, which spans practically the entire length of the sole 1 in a longitudinal direction, its thickness dimension increasing toward the sole rear. Advantageously, said reinforcing element 8 is formed with an expanded and flattened toe portion 8*a*, as viewed in plan view, which narrows progressively toward the center portion of the reinforcing element 8 to then widen progressively but less markedly toward the rear portion 8*b* of the reinforcing element 8. The thickness of the reinforcing element 8 is fairly small at the front portion 8*a* and increases progressively toward the rear portion 8*b*. Preferably, the reinforcing element 8 is not of solid construction but has a cell-like construction in its center and rear portions, wherein the cells are substantially rectangular and open at the top. The pattern of the reinforcing element 8 in the longitudinal direction, as viewed in elevation, is substantially curvilinear as a conventional sole, and not rectilinear as with currently used ski boots.

This configuration of the reinforcing element 8 imparts a substantial stiffness to the center and rear portions of the element and hence to the sole 1, and a good flexibility to the front or toe portion of the element, and hence the sole 1, exactly where flexibility is mandatory for comfortable walking. It should be noted that flexibility as specified is provided at an area which does not affect substantially the portion under stress by the binding release members.

Arranged at the flattened front portion 8*a* of the reinforcing element 8 is an engagement element 9 for releasable cooperation with a front release element 10 of a ski binding of the type disclosed in the cited patent. More specifically, the engagement element 9, which is configured substantially as a peg having an enlarged head as shown in FIGS. 1–4, is carried rigidly on a small plate 11 received, in parallel with the sole main plane, within a seat 12 in the reinforcing element 8 and being then embedded in the sole 1, the connection between the peg 9 and plate 11 being accomplished by upsetting. Thus, a strong connection of the engagement element 9 to the sole 1 is achieved and the prior art drawbacks effectively obviated. Advantageously, the plate 11 strengthens the front region of the reinforcing element 8 and sole 1, concentrating flexibility along the plate cross edges. It may be appreciated that this is specially advantageous when using the shoe for walking activites, and brings about no adverse effects in skiing, thanks to the plate extending parallel to the sole main plane.

The front release element 10 has a substantially much flattened V-like configuration, and is fastened to a ski 13 by means of screws passed through holes 14 in the element 10, thereby the apex of the "V" points toward the toe end of the ski shoe 2. The element 10 is provided, at the rear top region thereof, with a projecting lug 15 which, in use, fits between the head and base of the peg 9, thus providing front connection of the shoe 2 to the ski 13. The V-like configuration of the release element 10 provides the side release ability described in the cited patent, to which reference can be had for further details. Advantageously, the release element 10 may also be of cell construction, as shown in the drawings.

Formed in the rear face of the reinforcing element 8 is a recess 16 adapted for releasable engagement with a pusher element 17 of a rear automatic release assembly 18 of the ski binding. Said assembly would be advantageously configured as described in the cited patent. More specifically, the recess 16 is engaged by a ball 19 accommodated in the tip of the pusher element 17 and protruding therefrom.

Figures 4, 5, 6, 7, 8, 9, 10, 11:
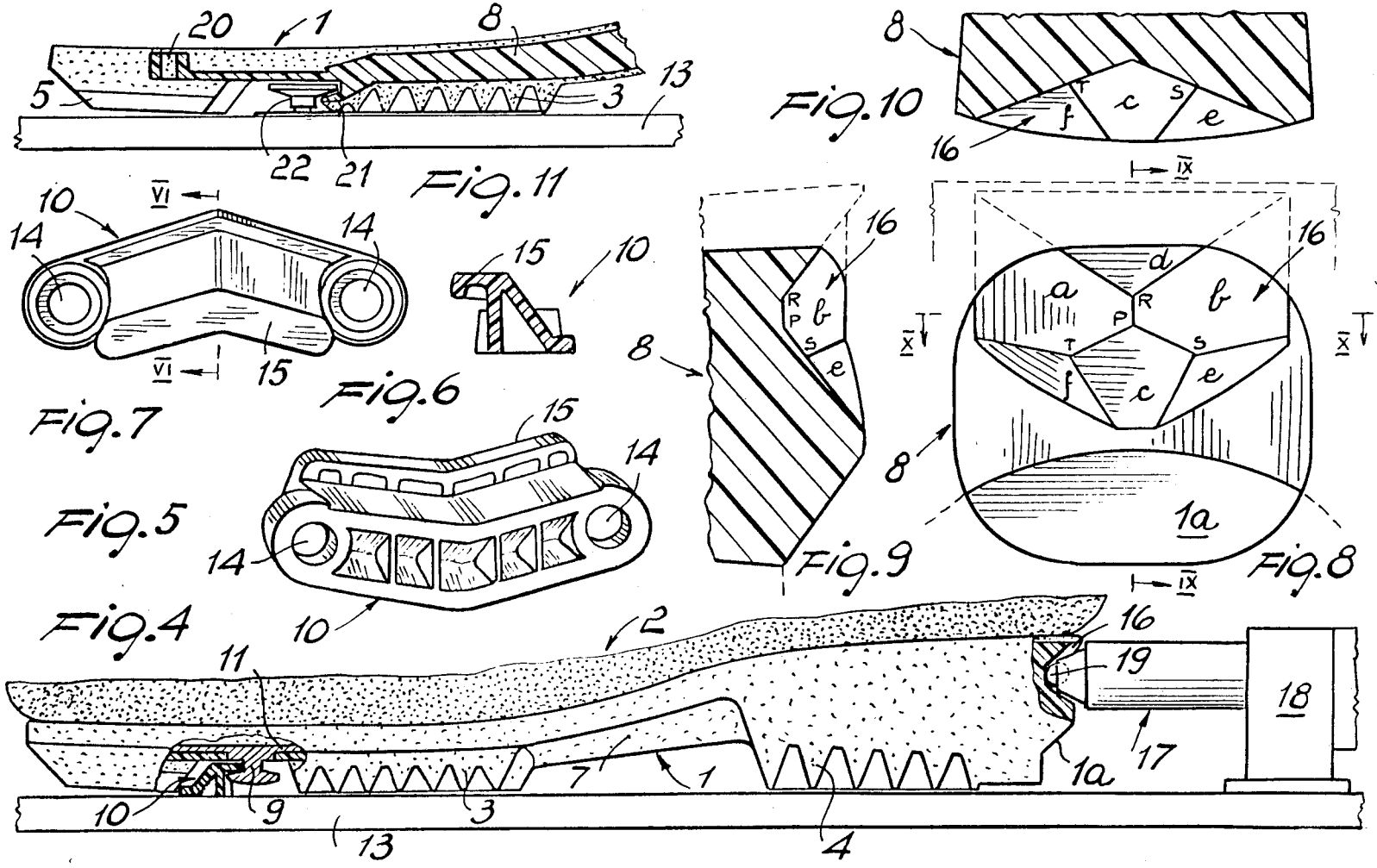
FIG. 4 is a fragmentary view of a shoe incorporating a sole according to the invention and being mounted on a ski binding of the type specified hereinabove.
FIG. 5 is a perspective view of a front release element adapted for attachment to a ski and cooperation with the peg-like engaging element affixed to the sole.
FIG. 6 is a sectional view of the front release element taken along the line VI—VI of FIG. 7.
FIG. 7 is a top view of that same release element.
FIG. 8 is a front view of the recess in the reinforcing element for the rear pusher element of the binding.
FIG. 9 is a sectional view taken along the line IX—IX of FIG. 8.
FIG. 10 is a sectional view taken along the line X—X of FIG. 8.
FIG. 11 illustrates a modified embodiment of the sole toe portion, with an engagement element formed on the reinforcing element and cooperating with a peg or pivoting roller carried on the ski.

Advantageously, the recess 16 is defined by a series of mutually converging surfaces, as shown in FIGS. 8,9 and 10. These are, more precisely, three surfaces a, b and c, arranged in contiguous pairs and convergigng along straight lines which, in turn, converge to a center point P defining the normal position of engagement of the ball 19, and three more surfaces d, e and f, interleaved peripherally to the surfaces a, b and c, and defining therewith further convergence lines, which converge toward three points, R, S, T, separate from the center point P but lying around it. Thus, differentiated release modes are achieved which are substantially independent of one another both sideways and in a vertically upward direction. In fact, for sideways release, the ball 19 engagement occurs initially along either of segments PT and PS to then continue in a substantially horizontal direction toward one or the other of the release sides, without substantially influencing the upward release mode. In other words, the convergence of the various surfaces leads to a mainly sideway mode of release under the effect of excessive laterally applied forces. By converse, in the vertically upward release mode, the engagement of the ball 19, after reaching either of the points T and S, occurs along segments having a mainly vertical component, without substantially influencing sideway release but rather returning the shoe to its centered position. It will be appreciated that this configuration of the recess 16 also enables restoration to normal operating conditions when the initial release bias has only been a temporary one, that is, release would not be completed before the points T or S have been reached. Complete release occurs along well defined directions, which may be either sideway or upward or combination directions.

An inclined lead-in surface 1*a* under the recess 16 in the reinforcing element 8 allows an easy engagement of the shoe 2 with the binding after the peg 9 has been engaged with the front release element 10 as disclosed in the cited Patent.

The sole just described may be manufactured by curing, thermoforming, or injecting the elastomeric material for the sole 1 around the reinforcing element 8. To ensure a stable connection, passageways 20 may be provided in the reinforcing element, e.g. in the front and rear portions thereof, for receiving the elastomeric material of the sole 1.

In the embodiment of FIG. 11, the reinforcing element 8 has an engagement element in the form of a lug 21 projecting into the crosswise cutout 6 toward the toe end of the sole 1, and defining a seating for a conical head widening out at the bottom of a peg 22 made rigid with the ski 13. In plan view, the pattern of the lug 21 is substantially that of a much flattened "V", having an equivalent function to that of the release element 10, but with a reverse angle arrangement, i.e. with wings extending outwards and toward the front portion of the reinforcing element 8. This improves safeguarding against premature releasing. Advantageously, the peg 22 could be a cylindrical element carried rotatably on the ski 13, with a roller formation instead of the head of the peg 22.

It should be understood that the reinforcing element 8, in addition to providing a means of engagement with the binding proper, imparts the sole 1 with the necessary stiffness, while allowing, owing to its shape and arrangement, a mainly elastic construction of the remainder of the sole 1, and as a whole, excellent flexibility of the sole where required, i.e. at the toe or front portion thereof.

Advantageously, the reinforcing element 8 may have a different shape from that shown, or be provided with reinforcing elements of its own, such as metal ones, incorporated thereto. Of course, where found appropriate, the reinforcing element 8 could also be a solid construction. The sole could have, for example, a solid base, i.e. be without the bridge 7 and adjoining hollow region. The reinforcing element 8 could be made up of several pieces held together, for manufacturing convenience. It could also include reinforcing side wings, e.g. such as to assume a substantially omega-like cross-sectional configuration. The plate 11 could be made longer and extend for a major part toward the center region of the reinforcing element 8. In addition to the passageways or holes 20 shown in the drawings, other passageways or holes could be provided for connecting the reinforcing element 8 to the elastic material of the sole. The recess 16 could be defined by surfaces more closely interconnected to one another; in particular, the bottom line defining the corners between the surfaces e, c, f and the rear outer surface of the reinforcing element 8 could be more markedly rounded.

Many other modifications and variations are, of course, feasible without departing from the scope of the instant inventive idea.

I claim:

1. A sole of a ski shoe, comprising:

(a) a body of relatively pliable material and having a crosswise cutout in the under surface of its toe portion;

(b) a reinforcing element embedded in the body, of a material stiffer than the body, extending from the heel to the toe area of the sole, the reinforcing element being substantially narrower than the width of the sole, and having a rear recess opening at the heel for engagement with the pusher element of a rear automatic release assembly of a ski binding and being provided with engagement means projecting into said crosswise cutout for engagement with a front automatic release assembly of the ski binding, the reinforcing element tapering from the heel to the toe area down to a thickness such that the toe portion of the sole has a substantial degree of flexibility.

2. A sole according to claim 1, wherein the reinforcing element is formed from a plastic material, and the body of the sole is made of rubber.

3. A sole according to claim 1, wherein said reinforcing element has a flattened and expanded toe portion.

4. A sole according to claim 1, wherein said engagement means at said crosswise cutout comprises a peg projecting downwardly into said crosswise cutout.

5. A sole according to claim 4, wherein said peg is integral with a metal plate made rigid with the reinforcing element.

6. A sole according to claim 1, wherein said engagement means at said crosswise cutout comprises a V-shaped lug on the reinforcing element, projecting forwardly into said crosswise cutout.

7. A sole according to claim 1, wherein said rear recess is defined by three contiguous surfaces converging in pairs along straight lines converging, in turn, toward a center point, and by additional three surfaces interleaved peripherally to said first-mentioned surfaces and defining in pairs therewith additional converging straight lines, said additional straight lines being set to converge in pairs toward points separate from said center point but lying around said center point.

* * * * *